United States Patent [19]

Müller

[11] 4,124,203

[45] Nov. 7, 1978

[54] APPARATUS FOR FORMING SHEET MATERIAL ASSEMBLAGES

[75] Inventor: Hans Müller, Zofingen, Switzerland

[73] Assignee: GRAPHA-Holding AG., Switzerland

[21] Appl. No.: 764,638

[22] Filed: Feb. 1, 1977

[30] Foreign Application Priority Data

Feb. 19, 1976 [CH] Switzerland ..... 2024/76

[51] Int. Cl.[2] ..... B65H 5/30

[52] U.S. Cl. ..... 270/55

[58] Field of Search ..... 270/54–58; 271/64, 173

[56] References Cited

U.S. PATENT DOCUMENTS

| | | | |
|---|---|---|---|
| 2,634,971 | 4/1953 | Schweizer | 270/55 |
| 3,420,516 | 1/1969 | Guggisberg | 270/55 |
| 3,944,207 | 3/1976 | Bains | 271/173 |

*Primary Examiner*—Edgar S. Burr

*Assistant Examiner*—A. Heinz

*Attorney, Agent, or Firm*—Peter K. Kontler

[57] ABSTRACT

A newspaper stuffing apparatus wherein pockets having fixedly mounted and pivotable walls travel along an endless path below a plurality of feeders which propel jackets and inserts of newspapers into successive pockets. In order to prevent the jackets from rebounding upon impact against intercepting levers below the pockets, each pocket is equipped with two spring-biased braking members which bear against the corresponding pivotable wall and extend toward the associated fixedly mounted wall during introduction of a jacket so that the braking members frictionally engage the jacket but do not prevent it from moving its folded edge all the way into engagement with the intercepting levers. The braking members are retracted in response to movement of the pivotable wall away from the associated fixedly mounted wall to thus provide room for opening of the jacket preparatory to introduction of inserts.

11 Claims, 5 Drawing Figures

APPARATUS FOR FORMING SHEET MATERIAL ASSEMBLAGES

BACKGROUND OF THE INVENTION

The present invention relates to improvements in apparatus for collating and otherwise manipulating sheet material articles, particularly sections of newspapers or the like. More particularly, the invention relates to improvements in so-called stuffing apparatus which can be used for assemblage of newspapers or other sheet material articles in openable pockets which are transported (normally along an endless path) past several feeding devices, for example, a series of bottom-feed hoppers each of which can discharge a different sheet material article into successive pockets.

In presently known newspaper stuffing apparatus, each pocket which contains an assembled newspaper is opened at a discharging station so that the newspaper can descend by gravity, e.g., onto a conveyor system which delivers it to a stacker or to another processing unit. It is also known to propel sheet material articles into successive pockets so that the introduction of each article into the respective pocket takes up an interval of time which is much shorter than the interval that elapses during introduction of an article under the action of gravity. Such mode of admitting sheet material articles into pockets is satisfactory as long as the speed of admission does not exceed a predetermined value. Once the predetermined speed is exceeded, the articles are likely to rebound and to assume positions which deviate from optimum positions. Rebounding of jackets presents serious problems in assembly of newspapers or the like because the sections of an assembled newspaper are not in accurate register with each other, e.g., the inner sections or inserts are likely to project beyond the jacket. This can interfere with further processing (particularly stacking) of multi-section newspapers, especially in automated printing plants.

OBJECTS AND SUMMARY OF THE INVENTION

An object of the invention is to provide a novel and improved apparatus for stuffing newspapers or other sheet material articles wherein the articles are not likely to or cannot rebound in the pockets even if the admission of such articles takes place at a speed greatly exceeding the speed which an article reaches upon completion of introduction under the action of gravity alone.

Another object of the invention is to provide novel and improved pockets for use in apparatus for stuffing newspapers or the like.

A further object of the invention is to provide a newspaper stuffing apparatus which embodies the improved pockets.

An additional object of the invention is to provide the apparatus with novel and improved means for automatically actuating certain component parts of pockets during travel of pockets past one or more stuffers.

An ancillary object of the invention is to provide the apparatus with novel and improved means for insuring highly reproducible admission of sheet material articles into and reliable retention of such articles in successive pockets.

A further object of the invention is to provide the apparatus with novel and improved means for preventing rebounding of sheet material articles (especially jackets of newspapers) in the pockets.

The invention is embodied in an apparatus for collating and otherwise manipulating sheet material articles, particularly in a newspaper stuffing apparatus wherein jackets are fed by one or more primary feeding devices and are thereupon opened up to receive inserts or inner sections of newspapers.

The apparatus comprises a plurality of pockets each having a preferably fixedly mounted first wall and a preferably pivotable second wall which can be moved toward or away from the respective first wall, a chain conveyor or analogous means for transporting the pockets in a predetermined direction along a predetermined path (preferably along an endless path), at least one stuffer adjacent the path and having at least one hopper or analogous device for feeding sheet material articles (e.g., newspaper jackets) between the first and second walls of successive pockets (the feeding device is preferably mounted above the path and may comprise means for propelling the articles into successive pockets at an elevated speed which can greatly exceed the speed at which the articles would descend under the action of gravity alone), and braking means associated with each pocket. Each braking means comprises one or more braking members extending into the path of and frictionally engaging the article which is in the process of entering the respective pocket during transport of such pocket past the feeding device.

Each braking means preferably further comprises one or more torsion springs or analogous means for biasing the respective braking member or members against the respective second wall, and each braking member preferably comprises a pallet or an analogous portion which extends beyond the inner side of the respective second wall (i.e., beyond that side which faces the associated first wall) and toward the associated first wall during movement of the corresponding pocket past the feeding device. The arrangement is preferably such that the braking members are automatically moved away from the associated first walls in response to opening of the pockets, i.e., in response to pivoting of second walls away from the corresponding first walls to allow for opening of the jackets and for introduction of one or more inserts into the thus opened jackets. Opening of the pockets takes place after the pockets advance beyond the device which serves to feed jackets, i.e., those articles which are about to receive one or more inserts.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
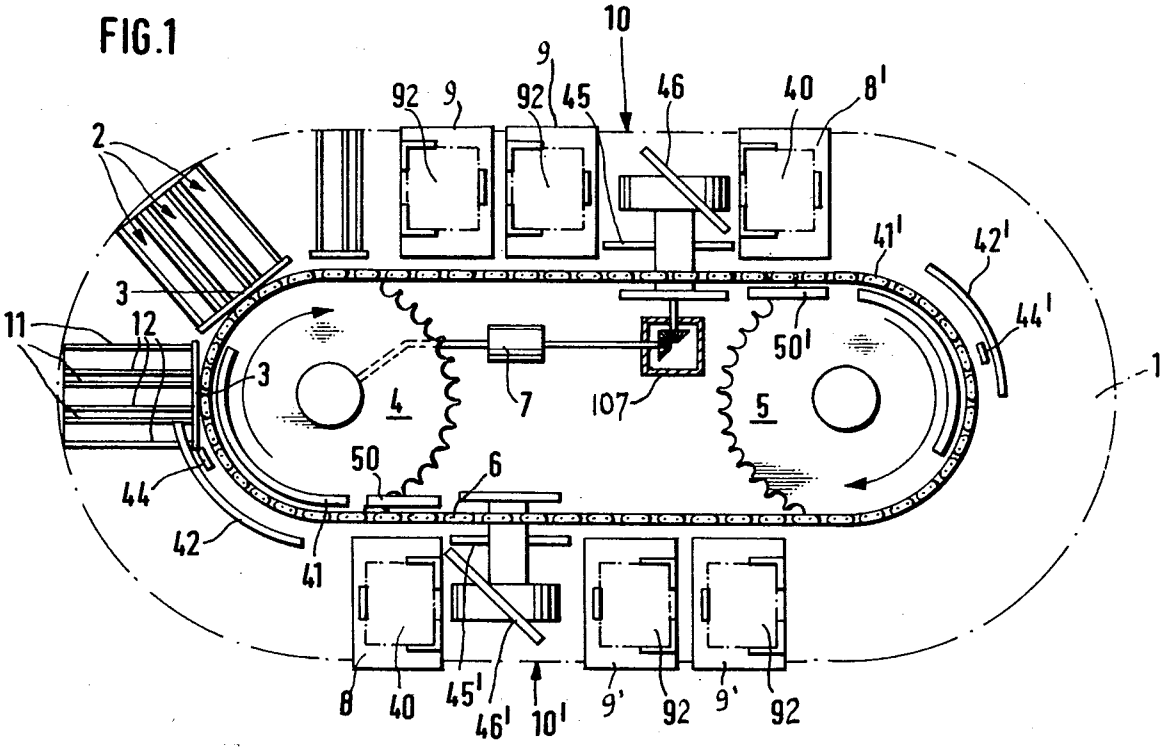
FIG. 1 is a schematic plan view of an apparatus which embodies the invention and comprises two stuffers as well as a discrete withdrawing or removing unit for each stuffer.

FIG. 1 shows certain features of a stuffing apparatus which embodies the invention. The mode of operation of this apparatus is somewhat similar to that of apparatus which are disclosed in U.S. Pat. Nos. 3,874,649 and 3,881,716 to Bryson et al. A chain conveyor which comprises an endless link chain 6 trained around two sprocket wheels 4, 5 defines a substantially oval endless path 1 for a series of groups of substantially V-shaped equally spaced pockets 2. The path 1 includes two elongated straight portions which are parallel to each other. Each group of three pockets 2 is mounted on a plate-like carrier 3 which is secured to the adjacent link of the endless chain 6. The shaft for the sprocket wheel 4 receives torque from a main prime mover 7, e.g., a variable-speed electric motor. The prime mover 7 drives several other components of the apparatus, e.g., through the medium of a bevel gear transmission 107. The directions in which the sprocket wheels 4 and 5 rotate when the prime mover 7 is on are indicated by arrows.

Figure 3:
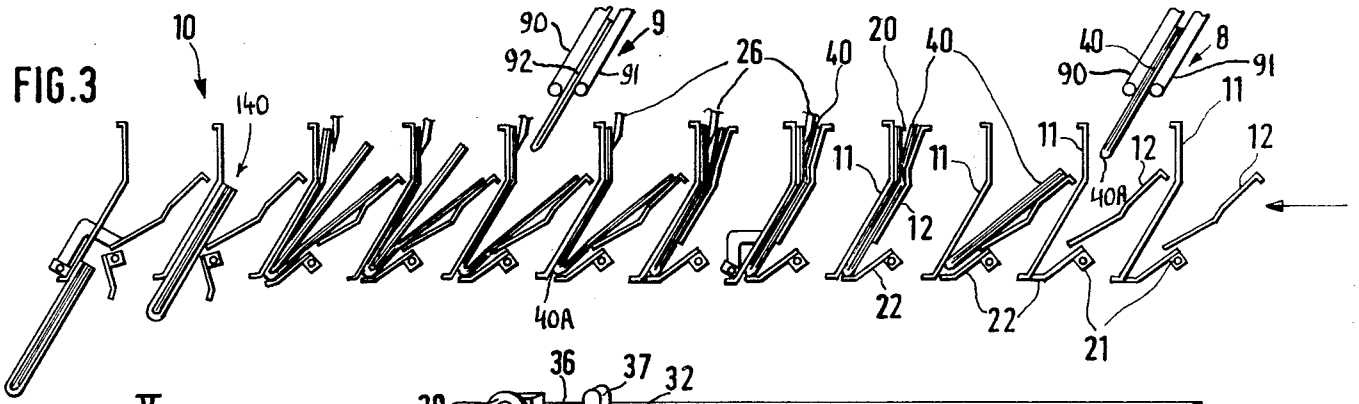
FIG. 3 is a schematic side elevational view of a series of pockets, showing the manner in which a complete newspaper is assembled therein during transport along the feeding devices of one of the two stuffers shown in FIG. 1.

The apparatus further comprises two stuffers and two preferably automatic withdrawing or removing units 10, 10' for fully assembled newspapers. The first stuffer comprises a primary feeding device 8 (hereinafter called feeder) for freshly printed jackets 40 (FIGS. 1, 3, 5) of newspapers and one or more (e.g., two) additional or secondary feeders 9 which store inserts 92 (e.g., preprinted sheets or groups of sheets) which are to be inserted into the oncoming jackets 40 to thus convert the jackets and inserts into fully assembled newspapers 140 (FIG. 3). The second stuffer comprises a primary feeder 8' for freshly printed jackets 40 and one or more (e.g., two) additional or secondary feeders 9' for preprinted inserts 92. The newspapers 140 are assembled or collated in the pockets 2, and the purpose of the removing units 10 and 10' is to positively withdraw or remove the contents of oncoming pockets 2, preferably at a speed exceeding the speed of evacuation of such contents by gravity alone. Removing units which can be used in the apparatus of FIG. 1 are disclosed in my commonly owned copending application Ser. No. 764,631 filed Feb. 1, 1977. Empty pockets 2 which advance beyond the removing unit 10' receive jackets 40 from the primary feeder 8 and inserts 92 from the secondary feeders 9; the thus assembled newspapers 140 are removed by the unit 10 and each empty pocket 2 which advances beyond the unit 10 receives a jacket 40 from the primary feeder 8' and inserts 92 from the associated secondary feeders 9'. The thus assembled newspapers 140 are removed by the unit 10' and each empty pocket 2 is then ready to receive a jacket 40 from the primary feeder 8. The jackets 40 and the inserts 92 can descend into the pockets 2 therebelow by gravity, and each jacket 40 is caused to descend in such a way that its folded edge or back 40A (FIGS. 3 to 5) is caused to enter into the deepmost or lowermost portion of the respective pocket. Feeders which can be used in the apparatus of FIG. 1 are disclosed, for example, in commonly owned British Pat. No. 901,816 or in Swiss Pat. No. 374,968. The removing units 10 and 10' deposit or otherwise advance successive assembled newspapers 140 onto a single conveyor system or onto two discrete conveyor systems for transport to a further processing station, e.g., to a stacker (not shown).

Figure 4:
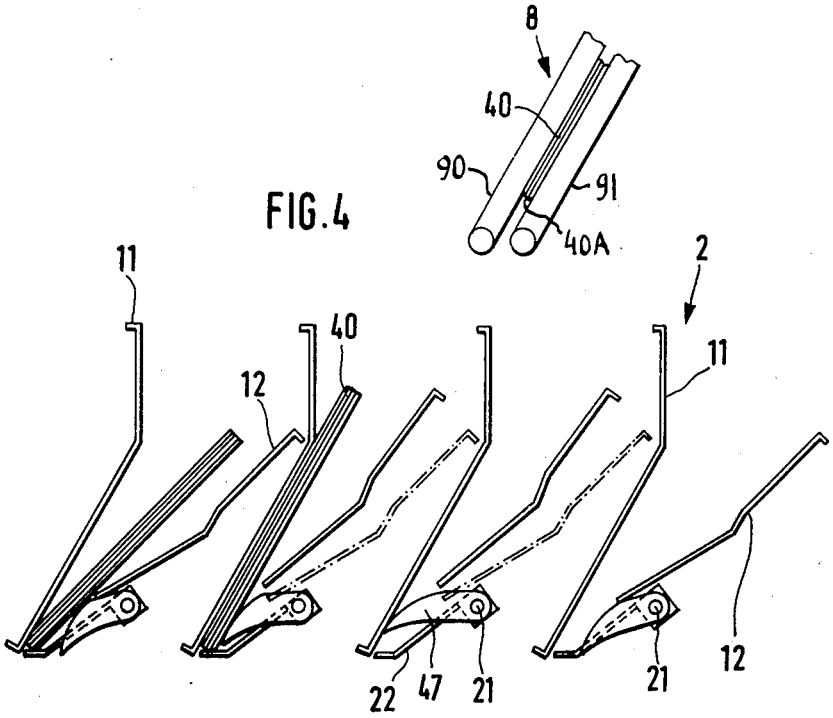
FIG. 4 is an enlarged view of a detail in FIG. 3.

FIGS. 3 and 4 show that each feeder may comprise two endless belt conveyors 90, 91 which can advance a successive jackets 40 or inserts 92 at a speed slightly or greatly exceeding the speed at which the articles 40, 92 would advance under the action of gravity alone. At an elevated speed of the conveyors 90, 91, and in the absence of any remedial action, the articles 40,92 would rebound on entry into the pockets 2 (jackets 40) or into the jackets (inserts 92).

Figure 2:
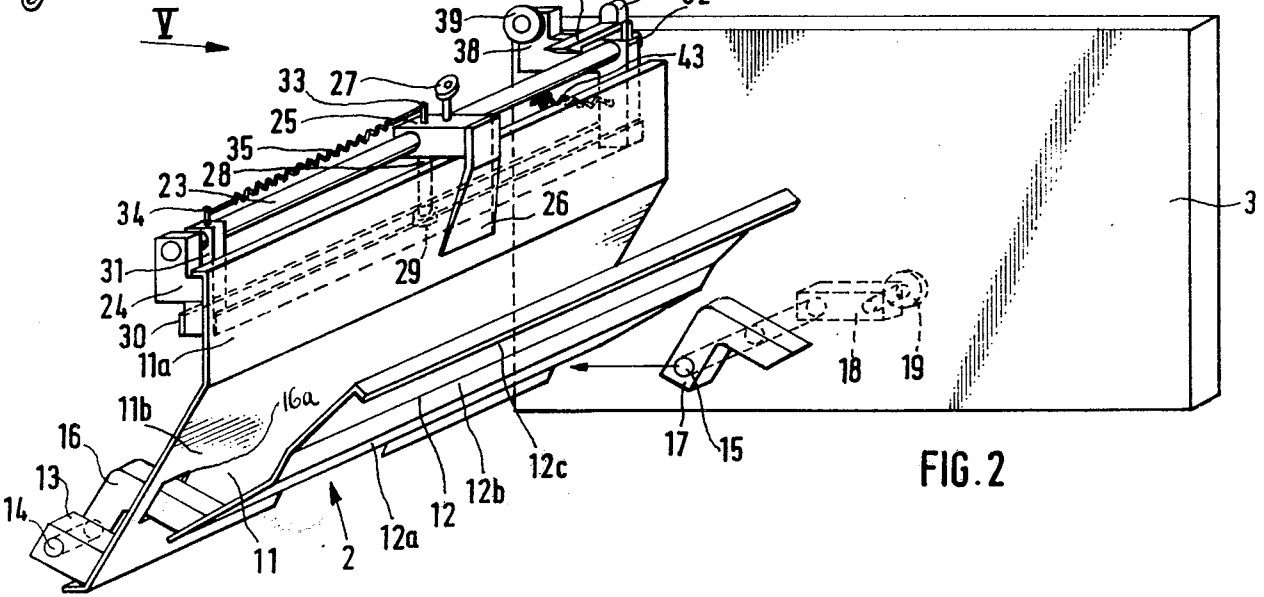
FIG. 2 is enlarged perspective view of one of a large number of pockets in the apparatus of FIG. 1.

FIG. 2 shows certain details of one of the pockets 2. As mentioned above, each plate-like carrier 3 supports a group of three identical pockets 2; however, two pockets of that group which includes the pocket 2 of FIG. 2 have been omitted for the sake of clarity. The illustrated pocket 2 comprises a stationary first wall 11 which is fixedly secured to the carrier 3 and a mobile second wall 12. The first wall 11 includes a substantially vertical upper section or panel **11*a* and a lower section or panel 11*b* which is inclined relative to and makes an obtuse angle with the upper panel 11*a*. The outer side of the lower panel 11*b* (i.e., that side which faces away from the inner side of the mobile second wall 12) carries a bearing 13 for a stub shaft 14 which is rigid with an L-shaped lever 16 constituting a first support for the wall 12. The stub shaft 14 is coaxial with a second shaft 15 (shown out of position in FIG. 2) which is rotatably mounted in the carrier 3 and is rigid with a second L-shaped lever 17 constituting a second support for the wall 12. The levers 16 and 17 are disposed at the opposite ends of the wall 11 and each thereof extends through a suitably configurated opening in the lower panel 11*b* (FIG. 2 shows the opening 16*a* for the lever 16). That end portion of the shaft 15 which extends rearwardly beyond the carrier 3 is rigid with a lever 18 for a roller follower 19. The latter tracks a stationary cam 41 or 41' (both shown in FIG. 1) during certain stages of movement of the pocket 2 along the path 1 whereby the roller follower 19 causes the wall 12 to pivot relative to the wall 11 about the common axis of the shafts 14 and 15 at intervals determined by the length and configuration of the cams 41 and 41'. The lever 18 may be biased clockwise, as viewed in FIG. 2, by a suitable spring (not shown), or the roller follower 19 can engage the aforementioned cam 41 or 41' owing to the weight of the wall 12 and of newspaper sections in the pocket 2 so that the wall 12 pivots anticlockwise, as viewed in FIG. 2, toward the adjacent side of the first wall 11 when the roller follower 19 engages the upper side of the cam 41 or 41'. It is assumed that the wall 12 tends to remain in the open position of FIG. 2 by gravity, i.e., that the wall 12 assumes the illustrated position as soon as the roller follower 19 advances beyond the cam 41 or 41'**.

The wall 12 comprises three sections or panels **12*a*, 12*b* and 12*c*. The lowermost and median panels 12*a*, 12*b* make an obtuse angle which is identical with or closely approximates the obtuse angle between the panels 11*a*, 11*b* of the first wall 11. The uppermost panel 12*c* is disposed in a plane which is substantially parallel to the plane of the lowermost panel 12*a*. When the wall 12 is pivoted toward or against the wall 11, the panels 11*a* and 12*c* define a wedge-like compartment 20 (FIG. 3**)

whose width increases upwardly, as viewed in FIG. 2 or 3.

The carrier 3 further supports a turnable supporting shaft 21 (see FIGS. 3–5) for each pocket 2 thereon. The shafts 21 are parallel to the respective pairs of shafts 14, 15 and each thereof supports two spaced-apart intercepting levers 22 having lower end portions which are bent toward the respective first walls 11 (see particularly FIGS. 3 and 4). Each shaft 21 is rigid with the respective levers 22 and its left-hand end portion (as viewed in FIG. 5) is rigid with a lever 51 for a roller follower 52 which tracks, at times, the periphery of a stationary cam 45 or 45′ (see FIG. 1) secured to the frame of the stuffing apparatus. The configuration of the upper side of the cam 45 or 45′ is such that the roller followers 52 cause the associated levers 51 to pivot the corresponding shafts 21 (and hence the corresponding pairs of intercepting levers 22) from first to second positions in which the levers 22 respectively extend close to (or actually contact) and are remote from the corresponding first walls 11. In their first or operative positions, the levers 22 insure that a newspaper 140 which is located in the respective pocket 2 cannot escape by sliding downwardly between the walls 11, 12. In the second positions, the levers 22 allow the removing unit 10 or 10′ to withdraw an assembled newspaper 140 from the respective pocket 2. The cams 45, 45′ respectively move the intercepting levers 22 away from the associated first walls 11 when the corresponding pockets travel past (above) the evacuating stations accommodating the removing units 10, 10′. During the major part of movement of each pocket 2 along the endless path 1, the corresponding intercepting levers 22 remain in the operative positions shown in FIG. 4.

Figure 5:
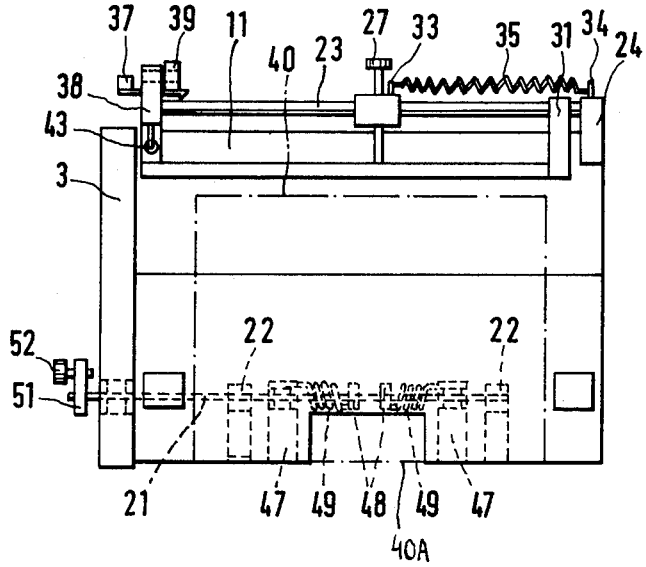
FIG. 5 is a smaller-scale rear elevational view of the pocket of FIG. 2 as seen in the direction indicated by arrow V.

FIG. 5 shows that each shaft 21 carries two retainers 48 which are non-rotatably secured thereto and are located substantially midway between the intercepting levers 22. Each shaft 21 further carries two rotatable braking members 47 which resemble pawls (see FIG. 4) and are biased by prestressed torsion springs 49. Each torsion spring 49 has a first end portion anchored in the adjacent retainer 48 and a second end portion anchored in the corresponding braking member 47 so that it tends to turn the braking member in a clockwise direction, as viewed in FIG. 4, i.e., toward the lower panel 11*a* of the respective first wall 11 and into engagement with the outer side of the corresponding mobile wall 12. When a braking member 47 abuts the adjacent mobile wall 12, a portion thereof extends beyond the lower edge and beyond the inner side of such wall and toward the corresponding wall 11.

FIG. 1 shows two stationary cams 50 and 50′ which are tracked by the roller followers 19 of successive levers 18. When a roller follower 19 engages the upper side of the cam 50 or 50′ (these cams are located immediately ahead of the cams 41, 41′, as considered in the direction of travel of pockets 2 along the path 1), the corresponding wall 12 is pivoted toward the associated wall 11 to such an extent (see FIG. 4) that the braking members 47 can reach or come very close to the lower panel 11*a* of the wall 11. Thus, when the conveyors 90, 91 of the primary feeder 8 or 8′ propel a jacket 40, at a high speed, toward and into the space between the walls 11, 12 of the oncoming pocket 2, the members 47 frictionally engage and brake such jacket so that the latter comes to a full stop in a predetermined position with respect to the walls 11 and 12. The braking members 47 can yield since they are biased by springs 49, and they prevent any rebounding of the jackets 40 on entry into the deepmost portions of the respective pockets 2. In the absence of braking members 47, the jackets 40 could rebound on impact against the corresponding intercepting levers 22. It has been found that the provision of braking members 47 contributes to a reduction of the number of improperly assembled or stuffed newspapers; especially as concerns the reduction of likelihood of misalignment or false orientation of jackets 40.

The retainers 48 for the torsion spring 49 can be replaced with a single retainer. It will be seen (note the positions and the length of the cams 50 and 50′ in FIG. 1) that the braking levers 47 are effective only during those stages of transport of pocket 2 along the endless path 1 when the pockets travel below the primary feeders 8 and 8′, i.e., below the feeders which admit jackets 40. When in the operative positions of FIG. 4, the braking members 47 extend beyond the lower edge of the respective wall 12, beyond the inner side of such wall, and into engagement with the wall 11 or with a jacket 40. The lower panel 11*b* of the wall 11 extends downwardly and beyond the lowermost panel 12*a* of the associated wall 12. Each braking member 47 normally abuts against the corresponding wall 12; therefore, the braking members move away from the wall 11 or from the jacket 40 on the corresponding levers 22 when the wall 12 is caused to pivot away from the wall 11. In other words, the braking members 47 move nearer to the wall 11 in response to pivoting of the wall 12 toward the wall 11, and vice versa.

Referring again to FIG. 2, the carrier 3 supports additional shafts 23, one for each pocket 2. One end of the shaft 23 shown in FIG. 2 is journalled in the carrier 3 and its other end extends into a bearing 24 at the outer side of the upper panel 11*a* of the first wall 11. The shaft 23 serves as a guide for a blockshaped holder 24 for a retaining blade 26. The holder 25 further carries an upwardly extending roller follower 27 and a downwardly extending projection or post 28 for a roller follower 29 received in an elongated U-shaped guide 30. The latter is fixedly secured to the shaft 23 by means of two upwardly extending beams 31 and 32 each having a polygonal outline. A helical spring 35 is connected to pins 33, 34 which are respectively secured to the holder 25 and beam 31; this spring tends to pull the blade 26 toward that end of the pocket 2 which is remote from the carrier 3.

The beam 32 supports a pivotable pawl 36 whose pallet can engage and retain the holder 25 for the blade 26, provided that the holder 25 is moved close to the carrier 3 to thereby cause the spring 35 to store energy. The pawl 36 has an upstanding protuberance 37 which can be moved to disengage the pawl from the holder 25 whereby the latter can move toward the beam 31 under the action of the spring 35, i.e., toward a central position (midway or substantially midway between the beams 31, 32) which is shown in FIG. 2.

The shaft 23 is further rigid with an L-shaped lever 38 which carries a roller follower 39. When the roller follower 39 is caused to move downwardly, as viewed in FIG. 2, the guide 30 is moved against the outer side and the blade 26 is moved away from the inner or front side of the wall 11.

When a pocket 2 travels below the primary feeder 8 of the first stuffer (FIGS. 3 and 4), the blade 26 is close to the respective carrier 3, i.e., the pallet of the pawl 36 engages the holder 25. Furthermore, the roller follower 19 allows the mobile wall 12 of such pocket 2 to assume the open position of FIG. 2 while the bent lower end portions of the corresponding intercepting levers 22 engage or are close to the front side of the lower panel 11*b* of the first wall 11 (this is shown in the right-hand portion of FIG. 3 an in FIG. 4). The conveyors 90, 91 of the feeder 8 propel a jacket 40 whose folded edge or back 40A enters the pocket 2 therebelow ahead of the remaining portion of such jacket (see particularly FIG. 4), and the folded edge 40A comes to rest on the intercepting levers 22.

During travel of a pocket 2 below the feeder 8, the corresponding roller follower 19 engages the cam 50. This results in movement of the wall 12 from the fully open position (shown in the rightmost portion of FIG. 4) to the partly open position (shown by solid lines in the middle of FIG. 4). Consequently, the braking members 47 can move close to the wall 11 and frictionally engage the descending jacket 40 with a force which does not suffice to prevent the folded edge 40A of such jacket from reaching the corresponding intercepting levers 22 but is sufficient to prevent any rebounding of the jacket 40 in response to impact of its folded edge 40A against the levers 22. The levers 22 are held in the operative positions of FIG. 4 while the roller follower 19 tracks the cam 50, i.e., such levers extend across the gap between the lowermost panel 12*a* of the wall 12 and the lower panel 11*b* of the wall 11 and automatically intercept and hold the introduced jacket 40 in a predetermined position with respect to the walls 11, 12 and the associated carrier 3. The retention of jacket 40 in such predetermined position is insured by the braking members 47 which prevent the jacket from rebounding in response to descent into engagement with the levers 22.

The conveyor chain 6 continues to transport the partially filled pocket 2 along the endless path 1 whereby the roller follower 19 engages the stationary cam 41 (e.g., an elongated rail) which is shown in FIG. 1. The second cam 41' is mounted downstream of the primary feeder 8' of the second stuffer. The cam 41 causes the wall 12 to pivot toward the wall 11, i.e., the jacket 40 whose folded edge 40A rests on the intercepting levers 22 is clamped between the walls 11 and 12. As mentioned above, the uppermost panel 12*c* of the wall 12 and the upper panel 11*a* of the wall 11 define a wedge-like compartment 20 when the lower panels 12*a*, 12*b* of the wall 12 are adjacent the wall 11; the compartment 20 enables the upper portion of the jacket 40 in the pocket 2 to open up so as to provide room for entry of the blade 26.

The chain 6 continues to move the pocket 2 along the path 1 whereby the roller follower 39 of the lever 38 reaches and is engaged by the fixed (but preferably adjustably mounted) cam or rail 42 which is shown in FIG. 1 and causes the shaft 23 to turn anticlockwise, as viewed in FIG. 2, against the opposition of a spring 43 which is attached to the beam 32. The blade 26 is thereby moved away from the upper panel 11*a* of the wall 11. The level of the cam or rail 42 is the frame of the stuffing apparatus is selected in such a way that the blade 26 is pivoted to a position substantially midway between the panels 11*a*, 12*c* of the pocket 2, i.e., substantially into the central longitudinal symmetry plane of the compartment 20. This insures that the blade 26 is then disposed in register with the gap between the halves of the opened-up jacket 40 in the pocket 2. A second adjustable cam or rail 42' is mounted downstream of the primary feeder 8' of the second stuffer.

The pocket 2 continues to move along the path 1 and the protuberance 37 of the pawl 36 strikes against and is pivoted by a stationary cam 44 (shown in FIG. 1) which automatically disengages the pallet of the pawl 36 from the holder 25 whereby the latter moves along the shaft 23 under the action of the spring 35. This causes the blade 26 to move into the gap between the halves of the jacket 40 in the pocket 2. Shortly or immediately thereafter, the roller follower 39 moves beyond the adjustable cam 42 so that the spring 43 is free to contract and turns the shaft 23 clockwise, as viewed in FIG. 2, in order to move the blade 26 against that half of the jacket 40 which lies against the inner side of upper panel 11*a* of the first wall 11.

During the next-following stage of movement of the pocket 2, the roller follower 19 moves beyond the cam 41 so that the wall 12 is free to pivot to the open position of FIG. 2. This enables one-half of the jacket 40 in the pocket 2 to follow the pivotal movement of the wall 12, i.e., the jacket opens up all the way to its folded edge 40A which rests on the intercepting levers 22. Such full opening of the jacket 40 is desirable and advantageous because it allows for introduction of a substantial number of inserts 92 and because it further insures that the leading edge of each insert 92 can slide all the way into the deepmost portion of the jacket 40. The inserts 92 are propelled by the conveyors 90, 91 of the feeders 9 which are located downstream of the cam 41 and upstream of the removing unit 10. The movement of wall 12 back to the fully open position entails a pivotal movement of braking members 47 away from the wall 11 so that the members 47 cannot interfere with entry of inserts 92 into the deepmost portion of the jacket 40. As mentioned hereinbefore, the springs 49 bias the braking members 47 against the wall 12 and the members 47 can move close to the wall 11 only when the wall 12 is out of the fully open position.

When the pocket 2 advances beyond the secondary feeders 9, the roller follower 52 on the lever 51 reaches and engages the stationary cam 45 which causes the shaft 21 to pivot the intercepting levers 22 to their retracted positions (i.e., away from the fixed first wall 11) so as to enable the removing unit 10 to rapidly withdraw the fully assembled newspaper 140 (including a jacket 40 and one or more inserts 92 therein) by way of the gap between the lowermost portions of the walls 11 and 12.

When the roller follower 52 engages the cam 45, the roller follower 27 engages a stationary cam 46 which pushes the holder 25 toward the carrier 3 to stress the spring 35 and to reengage the holder with the pallet of the pawl 36. Thus, the blade 26 is fully disengaged from the assembled newspaper 140 in the pocket 2 before the newspaper begins to leave the pocket. When the roller follower 52 moves beyond the cam 45, the levers 22 return into engagement with the wall 11 and the pocket 2 is ready to receive a jacket 40 from the primary feeder 8' of the second stuffer. The reference characters 44' and 46' denote in FIG. 1 cams which correspond to the cams 44 and 46 and are respectively located in the path of movement of successive protuberances 37 and roller followers 27 while the pockets 2 travel along that portion of the endless path 1 which is disposed between the removing units 10 and 10' (the pockets 2 are assumed to travel in a clockwise direction, as viewed in FIG. 1).

The means for arresting the blade 26 in the position of FIG. 2 (i.e., substantially midway between the levers 22) is not shown in the drawing. Such means may include a stop in the path of movement of the roller follower 27 or 29 or in the path of movement of the holder 25.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. In an apparatus for collating and otherwise manipulating sheet material articles, particularly in a newspaper stuffing apparatus, a combination comprising a plurality of pockets each having a first wall and a second wall; means for transporting said pockets in a predetermined direction along a predetermined path; at least one stuffer adjacent said path and having a first device for feeding first sheet material articles between the first and second walls of successive pockets during travel of such pockets along a first portion of said path and at least one second device for feeding second sheet material articles between the first and second walls of successive pockets during travel of such pockets along a second portion of said path; braking means associated with each of said pockets, each of said braking means including at least one braking member having means for frictionally engaging and gradually decelerating article while it is being fed into the respective pocket during transport of such pocket past said first feeding device; and means for reducing frictional engagement between said braking members and the first articles in the respective pockets during travel of said braking members along said second portion of said path.

2. A combination as defined in claim 1, wherein the second wall of each of said pockets has an inner side facing the respective first wall and each of said first walls has a lower portion extending downwardly beyond the respective second wall, each of said braking means further comprising means for biasing the corresponding braking member against the respective second wall, said braking members having portions located below the respective second walls and extending beyond the inner sides of the respective second walls and toward the lower portions of the associated first walls during movement of corresponding pockets past said first feeding device.

3. A combination as defined in claim 1, wherein said predetermined path is an endless path and said endless path is located at a level below said first feeding device, said first wall of each pocket having a lower portion disposed at a level below the respective second wall and each of said braking means further comprising means for urging the corresponding braking member against the respective second wall during transport of pockets past said first feeding device, each of said braking members having a portion disposed below and extending beyond the respective second wall and toward the lower portion of the associated first wall while such braking member moves past said feeding device.

4. A combination as defined in claim 1, wherein each of said pockets further comprises means for pivotably supporting the respective second wall for angular movement relative to the associated first wall, and further comprising means for pivoting said second walls toward the associated first walls during movement of successive pockets toward said feeding device, each of said braking means further comprising means for moving the corresponding braking member nearer to the associated first wall in response to pivoting of said second wall toward the respective first wall.

5. A combination as defined in claim 4, wherein at least a portion of each of said supporting means is mounted on the respective first wall.

6. A combination as defined in claim 1, further comprising a plurality of supports, one for each of said pockets, said supports being secured to said transporting means and extending substantially transversely of said direction, said braking members being pivotably mounted on the respective supports and each of said braking means further comprising means for biasing the respective braking member toward the corresponding first wall.

7. A combination as defined in claim 1, wherein at least said first feeding device comprises means for propelling articles into successive pockets.

8. In an apparatus for collating and otherwise manipulating sheet material articles, particularly in a newspaper stuffing apparatus, a combination comprising a plurality of pockets each having a first wall and a second wall; means for transporting said pockets in a predetermined direction along a predetermined path; a plurality of supports, one for each of said pockets, said supports being secured to said transporting means and extending substantially transversely of said direction, each of said supports including a shaft and said walls of each of said pockets being substantially parallel to the respective shafts, each of said pockets further comprising pivot means for the respective second wall and each of said pivot means defining an axis about which the respective second wall is turnable toward and away from the corresponding first wall; at least one stuffer adjacent said path and having at least one device for feeding sheet material articles between the first and second walls of successive pockets; and braking means associated with each of said pockets, each of said braking means including at least one braking member pivotably mounted on the respective support and having means for frictionally engaging the article which is being fed into the respective pocket during transport of such pocket past said feeding device, each of said braking means further comprising means for biasing the respective braking member toward the corresponding first wall, said biasing means being arranged to urge said braking members against the respective second walls so that the distance between said braking members and the associated first walls decreases in response to pivoting of said second walls toward the respective first walls.

9. A combination as defined in claim 8, further comprising means for pivoting said second walls toward the respective first walls during movement of said pockets toward said feeding device.

10. A combination as defined in claim 8, wherein said braking members have portions which yieldably engage the respective first walls during movement of said pockets past said feeding device whereby an article which is introduced by said feeding device moves between the braking member and the respective first wall.

11. In an apparatus for collating and otherwise manipulating sheet material articles, particularly in a newspaper stuffing apparatus, a combination comprising a plurality of pockets each having a first wall and a second wall; means for transporting said pockets in a predetermined direction along a predetermined path; at least one stuffer adjacent said path and having at least one device for feeding sheet material articles between the first and second walls of successive pockets; braking means associated with each of said pockets, each of said braking means including at least one braking member having means for frictionally engaging and gradually decelerating the article while it is being fed into the respective pocket during transport past said feeding device; and means for reducing frictional engagement between said braking means and the articles in respective pockets upon completion of entry of articles into the respective pockets.

* * * * *